US008695615B2

(12) United States Patent
Soma

(10) Patent No.: US 8,695,615 B2
(45) Date of Patent: Apr. 15, 2014

(54) SAFETY STRUCTURE FOR AUTOMATIC OPENING/CLOSING OF AN UMBRELLA

(75) Inventor: Kazuyuki Soma, Tokyo (JP)

(73) Assignee: Tokyo Maruso Co., Ltd., Tokyo (JP)

( * ) Notice: Subject to any disclaimer, the term of this patent is extended or adjusted under 35 U.S.C. 154(b) by 318 days.

(21) Appl. No.: 12/912,105

(22) Filed: Oct. 26, 2010

(65) Prior Publication Data

US 2011/0139200 A1 Jun. 16, 2011

(51) Int. Cl.

| | |
|---|---|
| ***A45B 19/08*** | (2006.01) |
| ***A45B 25/14*** | (2006.01) |
| ***A45B 25/16*** | (2006.01) |

(52) U.S. Cl.

USPC ..... 135/25.4; 135/24

(58) Field of Classification Search

USPC ..... 135/15.1, 22, 24, 25.1

See application file for complete search history.

(56) References Cited

U.S. PATENT DOCUMENTS

| | | | | | |
|---|---|---|---|---|---|
| 2,063,624 | A * | 12/1936 | Raab et al. | ..... | 135/75 |
| 2,515,493 | A * | 7/1950 | Buono | ..... | 135/75 |
| 5,806,545 | A * | 9/1998 | Ko | ..... | 135/24 |
| 6,481,450 | B2 * | 11/2002 | Chen | ..... | 135/24 |
| 7,588,041 | B2 * | 9/2009 | Huang | ..... | 135/24 |
| 2006/0201543 | A1 * | 9/2006 | Wu | ..... | 135/22 |
| 2009/0178699 | A1 * | 7/2009 | O'Donnell et al. | ..... | 135/16 |

* cited by examiner

*Primary Examiner* — David R Dunn
*Assistant Examiner* — Danielle Jackson
(74) *Attorney, Agent, or Firm* — McNeely, Hare & War LLP; Kevin J. McNeely

(57) ABSTRACT

In a safety structure for an automatic opening/closing umbrella, a completely locked-in condition is provided for determining whether or not the umbrella is closed and stored to prevent an accident caused a partially locked-in condition of the umbrella, such as a sudden pop-out of a handle part of the umbrella that hits any part of a user's body. The safety structure alleviates impacts and includes a mark and the handle part is made of an elastic material. When the rod is pushed into the handle part to enter an entry portion of the umbrella and reach a completely locked-in condition, the mark is labeled noticeably on the rod, and at least one distal portion of the handle part is made of a suitable elastic material such as polyurethane.

5 Claims, 5 Drawing Sheets

SAFETY STRUCTURE FOR AUTOMATIC OPENING/CLOSING OF AN UMBRELLA

CROSS-REFERENCE TO RELATED APPLICATIONS

This utility patent application claims priority to Japanese Patent Application Serial Number 2009-008844 filed on Dec. 14, 2009, which is incorporated by reference herein.

BACKGROUND OF THE INVENTION

1. Field of the Invention

The present invention relates to a safety structure for automatic opening/closing umbrella.

2. Description of the Related Art

A conventional automatic opening/closing umbrella as disclosed in Japanese Patent Laid-Open No. H05-031003 includes a press button for opening the umbrella automatically by pressing the press button once and closing the umbrella automatically by pressing the press button once again. Such automatic opening/closing umbrella provides a convenient application and has a very large market share in the umbrella market of the United States, but the utility rate of such umbrella in Japan is not very high due to safety concern.

As a handle of the automatic opening/closing umbrella usually pops out when the umbrella is closed for storage, accidents caused by such umbrella occur frequently. In general, this issue does not exist if a rod is pushed into a handle part to close the umbrella before a click sound is produced. Accidents usually occur if insufficient force is applied to press the rod into the handle part, without entering into a completely locked-in condition. When the force applied by a user's hand for supporting the umbrella is released or the user's hand is released directly, the handle or the umbrella tip may pop out and hit a user's face or injure the user.

At present, the conventional automatic opening/closing umbrella prevents the aforementioned accident by prohibiting users to operate the umbrella when the umbrella is close to a user's face, but such protection is insufficient and inconvenient to users.

SUMMARY OF THE INVENTION

In view of the shortcomings of the prior art, it is a primary objective of the invention to overcome the aforementioned shortcomings and deficiencies by providing a safety structure for an automatic opening/closing umbrella, such that when the umbrella is closed and stored, a completely locked-in condition of the umbrella is provided for determining whether or not the umbrella is locked properly and alleviating impacts caused by a possible pop-out of a handle part of the umbrella that may hit a certain part of a user's body, and preventing an accident caused by an incompletely locked-in condition of the umbrella.

To achieve the foregoing objectives, the present invention provides an automatic opening/closing umbrella having a locking mechanism for locking a rod which is pushed into a handle part of the umbrella for closing and storing the umbrella. After the rod is pushed into the handle part to reach a completely locked-in condition, a portion of the rod will slightly resume its position towards the outside, so that when the rod is pushed into the handle part to reach the completely locked-in condition, the rod which is labeled with a mark is entered into an entry portion of the handle part.

At least a part including a distal portion of the handle is made of an elastic material such as polyurethane.

The safety structure of the automatic opening/closing umbrella in accordance with the present invention includes a mark labeled on the rod to indicate that the rod is pushed into the entry portion of the handle part to reach a completely locked-in condition, when the rod is entered into the entry portion of the handle part to close and store the umbrella. When the umbrella is closed and stored and the rod is inserted into the handle part, users can see the mark while closing the umbrella. When the mark on the rod is entered into the handle part completely and cannot be seen anymore, it indicates that the rod has reached a completely locked-in position, and it is not situated in an incompletely locked-in condition, so as to prevent a possible accident in advance.

In addition, at least one distal portion of the handle part is made of an elastic material such as polyurethane to alleviate impacts caused by a sudden pop-out of the handle part that may hit a certain part of the user's body.

DETAILED DESCRIPTION OF THE PREFERRED EMBODIMENTS

Figure 1:
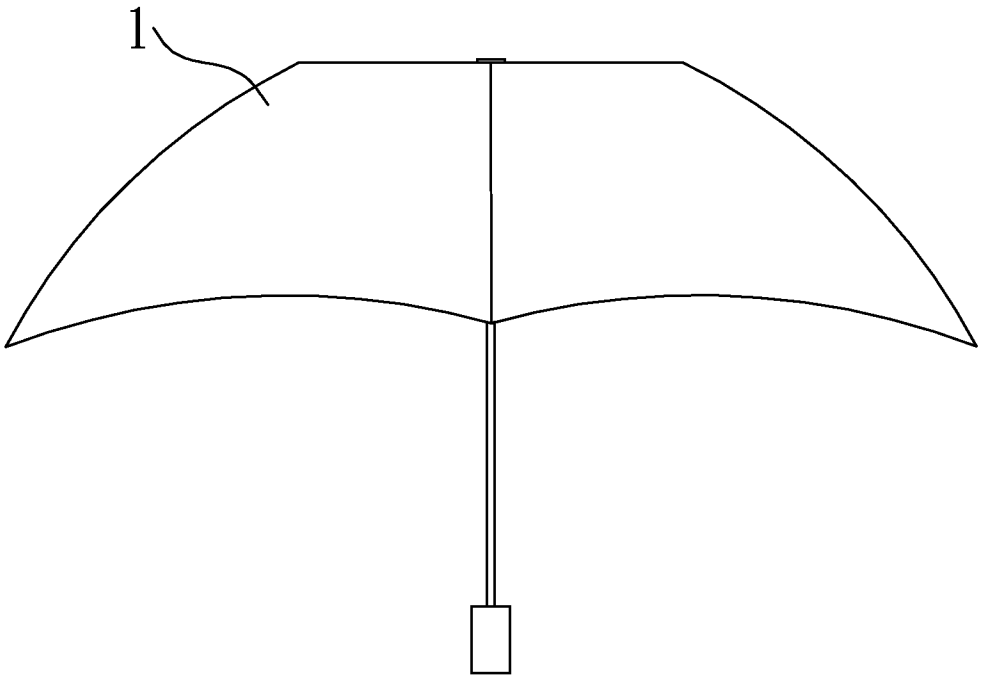
FIG. 1 is a front view of a safety structure of an automatic opening/closing umbrella in an open state when an ON button of the umbrella is pressed.
Figure 2:
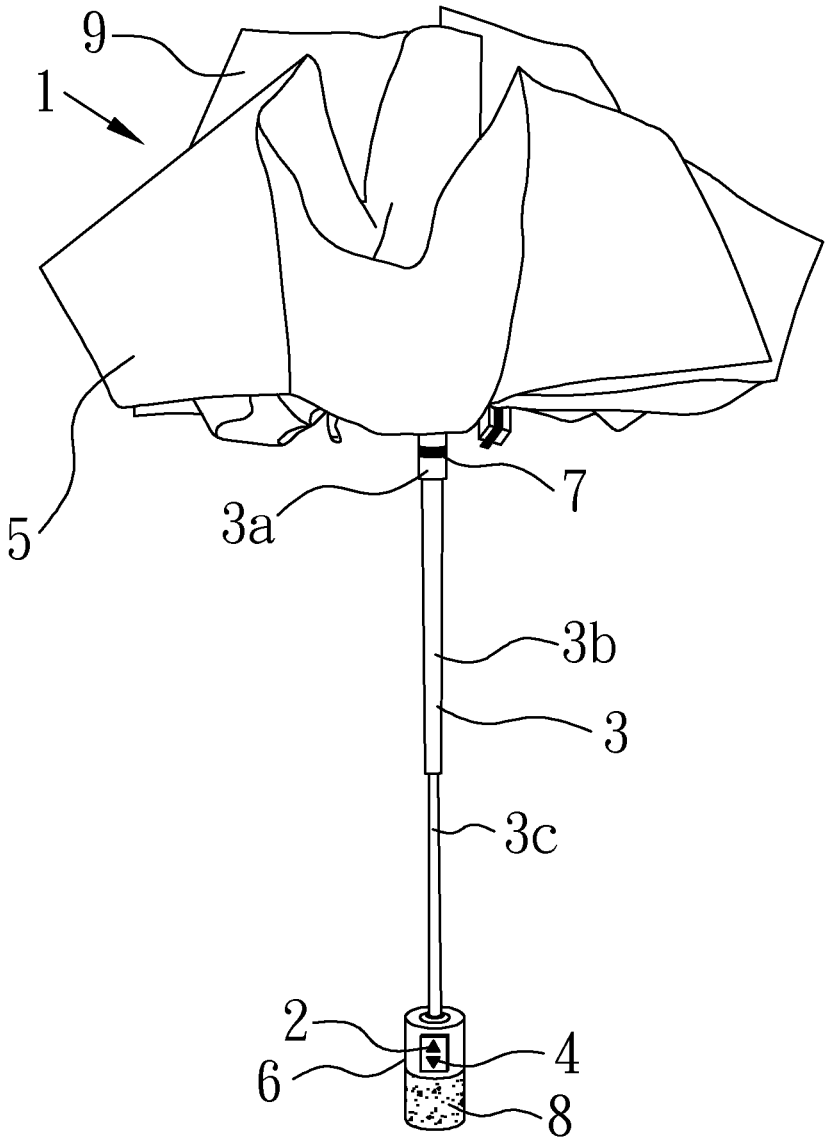
FIG. 2 is a perspective view of a safety structure of an automatic opening/closing umbrella in a closed state when an OFF button of the umbrella is pressed.
Figure 3:
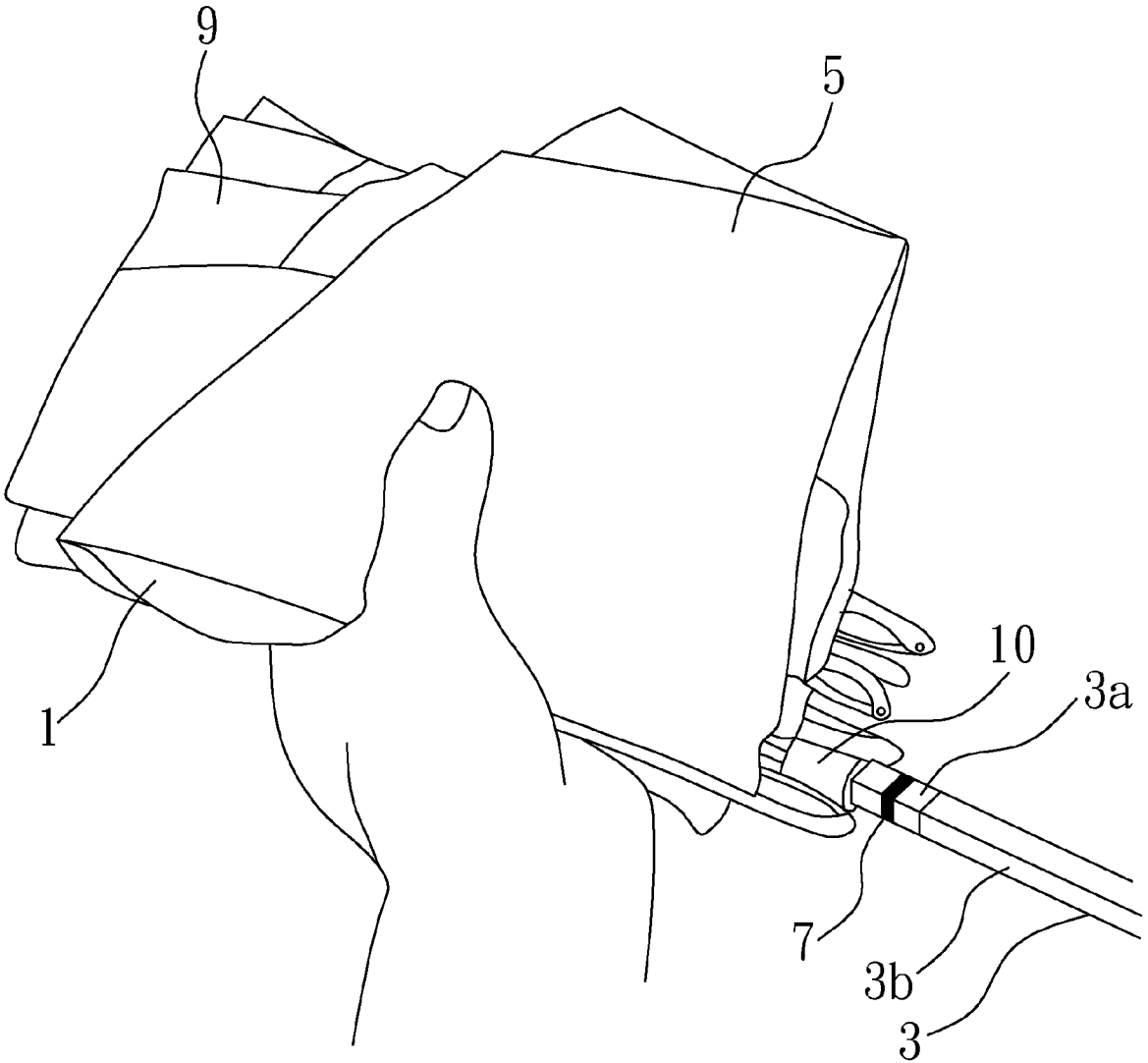
FIG. 3 is a schematic view of an automatic opening/closing umbrella in a storage state when a canopy of the umbrella is folded.

The technical characteristics of the present invention will become apparent with the detailed description of preferred embodiments and the illustration of related drawings as follows. It is noteworthy to point out that same numerals are used for referring to the same respective elements to describe and illustrate the invention.

When a rod of an automatic opening/closing umbrella of the present invention is pushed into a handle part to reach a completely locked-in condition, a user can see a mark on the rod.

In addition, at least one distal portion of the handle part is made of an elastic material such as polyurethane.

With reference to FIGS. 1 to 5 for a safety structure of an automatic opening/closing umbrella in accordance with a preferred embodiment of the present invention, when the automatic opening/closing umbrella 1 is used, an ON button 2 is pressed to extend a rod 3 to open the umbrella automatically. On the other hand, an OFF button 4 is pressed to expose an inside surface 5 of canopy of the umbrella to the outside in order to close and store the umbrella (and the umbrella has the advantage of closing and storing the umbrella without getting the user's hands wet). In addition, the rod 3 will not be contracted automatically, but the umbrella is operated and folded manually by pushing the rod 3 into a handle part 6.

The rod 3 can be a multi-sectional rod including a top section shaft 3*a*, a second section shaft 3*b* and a hand-held shaft 3*c*, and the rod 3 is pushed into the handle part 6 to reach a completely locked-in condition, and moved along the top section shaft 3*a* to an external periphery of an entry portion of the handle part 6, and a ring band 7 is printed to act as a mark.

Figure 4:
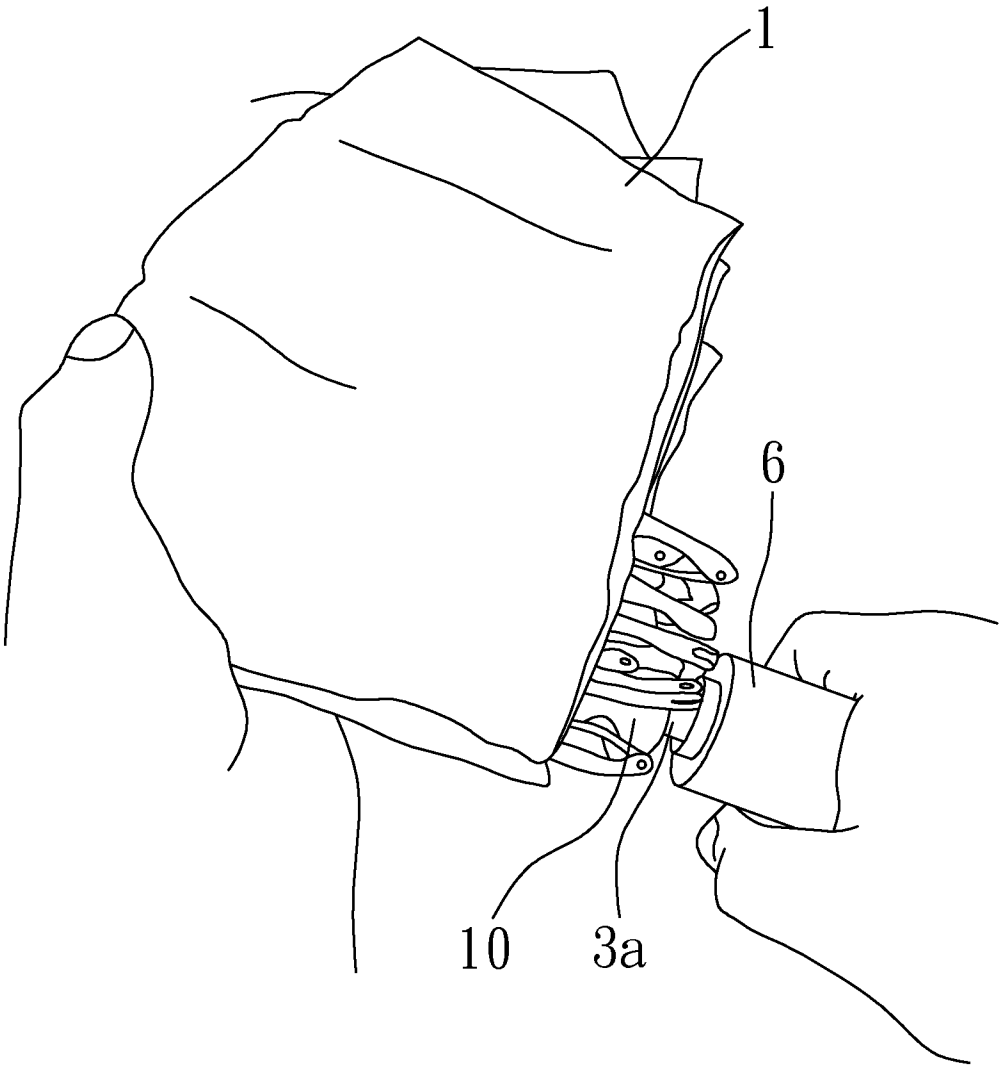
FIG. 4 is a schematic view of a locked-in condition when a rod is pushed into a handle part.
Figure 5:
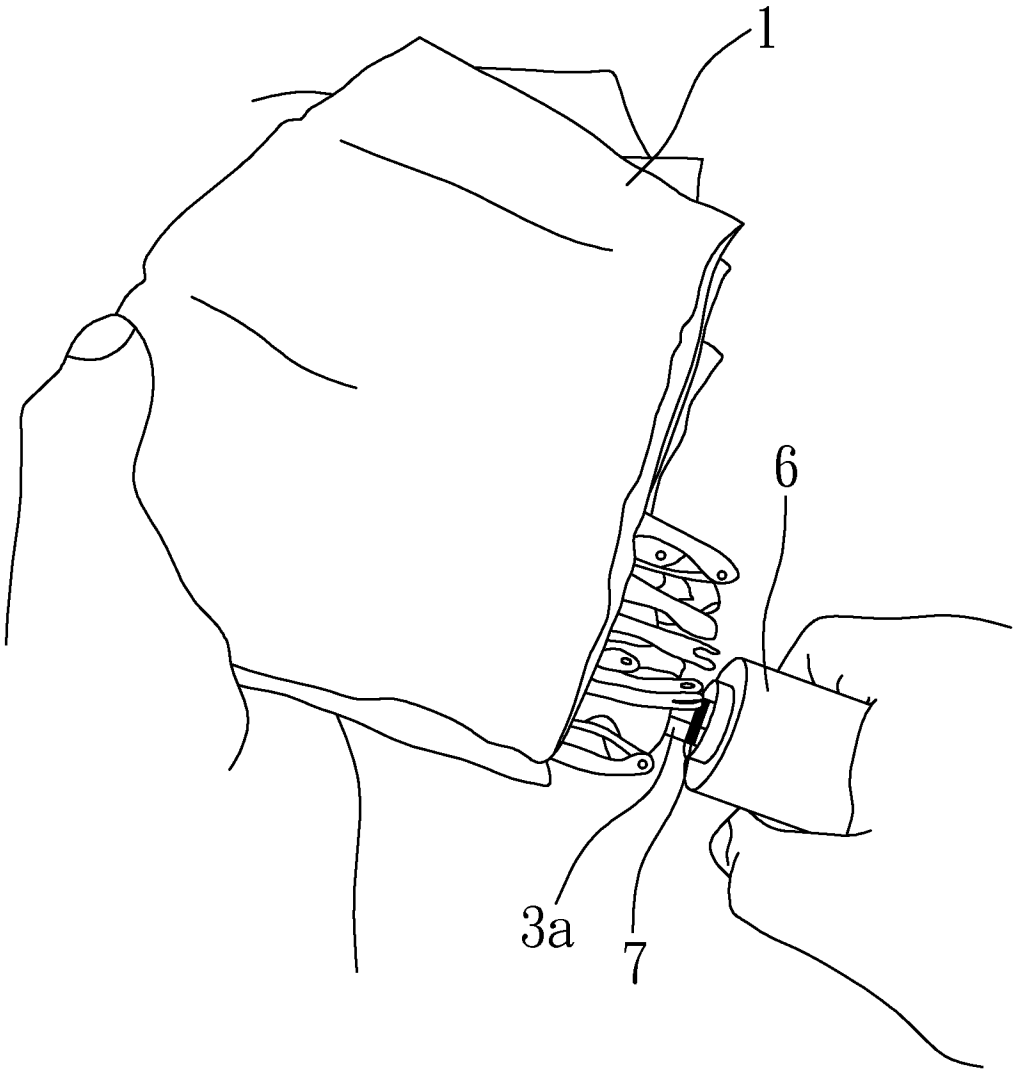
FIG. 5 is a schematic view of a rod resuming its original position in a completely locked-in condition.

In a practical application as shown in FIG. 4, when the umbrella is closed and stored, the canopy is folded, and then the rod 3 (shown in FIG. 3) is pushed into the handle part 6 to reach the completely locked-in condition, and the top section shaft 3*a* is entered into an external periphery of the entry portion of the handle part 6, wherein the rod 3 is printed with a ring band 7 (shown in FIG. 3) as the mark, such that if the ring band 7 cannot be seen when the rod 3 is pushed into the handle part 6, it implies that the rod 3 is pushed to reach a completely locked-in condition and locked by a locking mechanism (not shown in the figure) installed in the handle part 6. After the rod 3 is pushed to reach a completely locked-in condition as shown in FIG. 5, the rod 3 will slightly resume its position from the locking mechanism, so that the ring band 7 can be recognized again.

In addition, the distal portion of the handle part 6 is coated with polyurethane 8 to alleviate impacts caused by a sudden pop-out of the handle part that may hit a certain part of the user's body.

The numerals 9 and 10 of the figure represent an outside surface of canopy and a runner of the umbrella respectively.

In the foregoing preferred embodiment, the ring band is printed as the mark, but the invention is not limited to such arrangement only, and any equivalent method of forming a mark on the rod is applicable for the present invention. In addition, any appropriate shape and pattern of the mark can be selected freely. The distal portion of the handle part 6 is coated with polyurethane 8, but the present invention is not limited to such arrangement, and any equivalent way capable of providing an elastic structure at a distal portion of the handle part 6, regardless of its shape or material, is applicable for the present invention. In the foregoing preferred embodiment, an OFF button 4 is provided for closing the automatic opening/closing umbrella and exposing the canopy to the outside by pressing the OFF button of the automatic opening/closing umbrella, but the present invention is not limited to such arrangement only, and any equivalent way of pushing the rod 3 into the handle part 6 to reach a completely locked-in condition can be adopted, and any structure having a locking mechanism capable of slightly resuming a portion of the rod to its original position outward can be adopted for the automatic opening/closing umbrella of the invention.

In the safety structure of the automatic opening/closing umbrella in accordance with the present invention, the rod is pushed into the handle part to reach the completely locked-in condition, and the mark is formed on the rod to where the rod is entered, so that when the umbrella is closed and stored, the rod is pushed into the entry portion of the handle part, while the user is observing the mark and operating the umbrella. If the mark of the rod is entered into the handle part and cannot be seen, it shows that the rod has already reached the completely locked-in position, so as to prevent an accident caused by an incompletely locked-in condition of the umbrella.

In addition, at least one distal portion of the handle part is made of an elastic material such as polyurethane for alleviating impacts caused by a sudden pop-out of the handle part that may hit a certain part of the user's body.

What is claimed is:

1. An automatic opening/closing umbrella, comprising:

a handle;

a multi-sectional rod including a top section shaft moveably attached to a second section shaft which is moveably attached to a hand held shaft; and an umbrella canopy attached to the top section shaft;

wherein actuation of an on button on the handle extends the multi-sectional rod to open the umbrella canopy;

the multi-sectional rod is pushed into the handle to reach a locked-in condition; and a ring band on the top section shaft is configured to move inside the handle such that the ring band is no longer visible as soon as the umbrella is pushed to the locked-in condition.

2. The structure of claim 1, further comprising:

an off button on the handle, wherein actuation of the off button causes the umbrella canopy to collapse in order to close and store the umbrella canopy.

3. The structure of claim 1, wherein after the multi-sectional rod is pushed to reach the locked-in condition and pressure on the multi-sectional rod is released, the multi-sectional rod resumes its position relative to the locking mechanism so that the ring band is visible again.

4. The structure of claim 1, wherein the distal portion of the handle part is coated with polyurethane to alleviate impacts caused by a sudden pop-out of the handle part that may hit a certain part of a user's body.

5. An automatic opening/closing umbrella, comprising:

a multi-sectional rod including a top section shaft moveably attached to a middle section shaft which is moveably attached to a bottom section shaft;

a handle that is attached to the bottom section shaft, the handle including a cylindrical sleeve with a circular distal portion that is covered with an elastic cushioning material to absorb impact caused by a sudden pop-out of the handle part; and an umbrella canopy attached to the top section shaft;

wherein the multi-sectional rod is pushed into the handle to reach a locked-in condition; and a ring band on the top section shaft is configured to move inside the handle such that the ring band is no longer visible as soon as the umbrella is pushed to the locked-in condition.

* * * * *